United States Patent [19]

Williams, Jr.

[11] Patent Number: 4,729,516

[45] Date of Patent: Mar. 8, 1988

[54] FLUFF MILL

[75] Inventor: Robert M. Williams, Jr., Webster Groves, Mo.

[73] Assignee: Williams Patent Crusher and Pulverizer Company, St. Louis, Mo.

[21] Appl. No.: 851,957

[22] Filed: Apr. 14, 1986

[51] Int. Cl.[4] ..... B02C 13/28; B02C 13/286

[52] U.S. Cl. ..... 241/186.4; 241/189 R; 241/194; 241/222

[58] Field of Search ..... 241/73, 186 R, 186.1, 241/186.2, 186.4, 191, 194, 195, 197, 300, 222

[56] References Cited

U.S. PATENT DOCUMENTS

| | | | |
|---|---|---|---|
| 287,392 | 10/1883 | Ross | 241/186.4 |
| 573,883 | 12/1896 | Kaltenbrunn | 241/186.4 |
| 1,492,102 | 4/1924 | Nelson | 241/189 R |
| 2,152,108 | 3/1939 | Tice | 241/189 R X |
| 2,226,741 | 12/1940 | Randolph | 241/194 X |
| 2,597,333 | 5/1952 | Jindrich | 241/189 R X |
| 2,607,538 | 8/1952 | Larson | 241/194 |
| 2,924,057 | 2/1960 | Sonmore | 241/194 X |
| 3,190,064 | 6/1965 | Wenzel et al. | 241/194 X |
| 3,637,146 | 1/1972 | Banks | 241/194 |
| 3,823,878 | 7/1974 | Ishikura | 241/188 R X |
| 3,929,296 | 12/1975 | Stoeber | 241/197 |
| 4,030,672 | 6/1977 | Borgquist | 241/189 R X |
| 4,030,865 | 6/1977 | Kobayashi | 241/189 R X |
| 4,129,262 | 12/1978 | Lowry | 241/197 |

FOREIGN PATENT DOCUMENTS

| | | | |
|---|---|---|---|
| 1105880 | 7/1955 | France | 241/194 |
| 2458211 | 2/1981 | France | 241/194 |
| 11029 | 12/1972 | Japan | 241/189 R |

*Primary Examiner*—Mark Rosenbaum

*Attorney, Agent, or Firm*—Gravely, Lieder & Woodruff

[57] ABSTRACT

A fluff producing mill for converting a pulp material into an absorbent fluff product by the operation of a hammer rotor having multiple overlapping hammer clusters which describe a hammer tip circle, and a pulp material feeder positioned to present the pulp material radially into the hammer rotor between a breaker bar and a cooperating guide plate, the feeder supporting the breaker bar so it can be adjusted toward and away from the hammer tip circle to accommodate hammer clearance at the breaker bar.

7 Claims, 4 Drawing Figures

FLUFF MILL

BACKGROUND OF THE INVENTION

1. Field of the Invention

This invention pertains to a rotary fluff mill having a special arrangement of hammers and feed of material to produce a fluff product having great absorbency for use in production of household absorbent goods, such as disposable baby diapers and feminine napkins.

2. Description of the Prior Art

Fluff is a product whose source is a bleached wood fiber that is ground and laid out in matt form that renders it absorbent. While the product from this source is known, the apparatus for converting the pulp to a fluff has had several acute problems in setting up a grinding mill to yield the best or most acceptable conditions to obtain the most absorbent fluff product at minimum cost. More specifically, the older mills were provided with non-adjustable breaker bars that could only be adjusted and manually fitted while the mill was not operating. It is understood that it is necessary to control the gap spacing between the hammer circle of travel and the breaker bar in order to control the production of broken fibers versus unground material. These factors are important to yield a final product with ability to absorb more or less fluids. Control over the gap spacing is difficult with known types of mills due to the wide variances in tolerances in the manufacturer of such mills.

There are other problems in the prior art such as the usual feed of the material in a direction generally tangential to the hammer circle which requires an excess of power conumption in the drive for the mill. Another problem resides in following the conventional practice of arranging the hammers in spaced relation which creates dead zones where no grinding occurs, this being the result of the use of solid center discs and conventional hammers which are not dimensionally accurate and which cannot hold proper clearance of the breaker plate at the hammer circle.

BRIEF DESCRIPTION OF THE INVENTION

It is a general object of the present invention to provide a fluff mill for producing a more absorbent fluff product than can be produced by the older mills.

More specifically, the objects of the present invention are to provide a fluff mill with capability of adjusting the hammer clearance at the breaker bar while the mill is operating, to provide a rotor in which the hammers give full coverage at the breaker bar for improving the character of the product, and to provide hammers that are dimensionally accurate for long periods of use.

The present fluff mill embodies important improvements over older mills. For example, tests have shown that by controlling the gap between the hammer circle and the breaker bar it is possible to optimize the actual grinding conditions that exist in a normal day's operation. Further tests have shown that introducing the material feed at right angles to the hammer circle the mill can be operated in a more optimum manner in the power demand requirements to produce fiberization at low cost. By feeding the material in this manner the mill optimizes the horse power requirement and permits the ability to index the feed in or out relative to the entire assembly to maintain a set clearance between the hammer circle and the breaker bar.

A preferred mill embodiment comprises an arrangement of a rotor having clusters of hammers in overlapping relationship to provide full coverage in moving past a breaker bar to the incoming material in rolls or sheet form to be fiberized and turned into fluff which can be air blown out of the mill. More particularly, the fluff mill embodies a casing defining a chamber in which a fluff product is produced, means for feeding sheet material radially into the chamber relative to the axis of rotation of a rotor assembly, clusters of hammers arranged in overlapping positions around the axis of rotation to define a tip circle into which the sheet material is fed, breaker bar means supporting the sheet material closely adjacent the tip circle and means for permitting adjustments in the position of the breaker bar while the fluff mill is in operation.

BRIEF DESCRIPTION OF THE DRAWINGS

The accompanying drawings have set forth certain details of the inventive concept, wherein.

DETAILED DESCRIPTION OF THE EMBODIMENT

Figure 1:
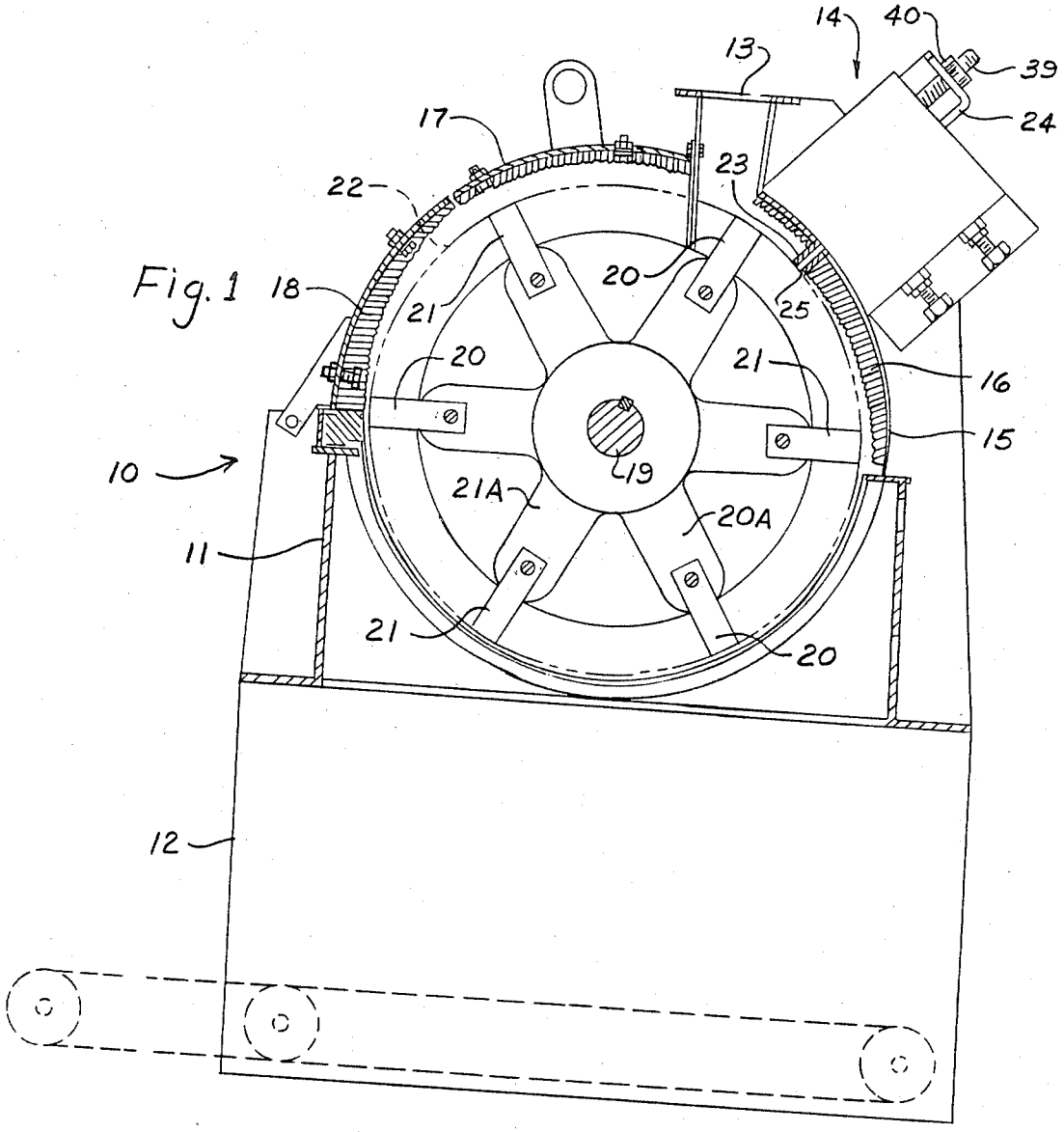
FIG. 1 is a sectional view of a fluff mill which exhibits the characteristics of the present invention.

FIG. 1 illustrates a typical environment for the purpose of showing the utility of the present fluff mill. The mill proper 10 includes a housing 11 which is mounted on top of a base 12 which contains the necessary rotary screen mechanism which collects the fluff as it is expelled from the housing 11 and forms it into a matt. Although not shown, the excess fluff is skimmed off of the travelling screen and is conveyed by a suitable blower arrangement and returned to an inlet 13 at the top of the mill housing 11.

The present invention is concerned primarily with the novel and unique characteristics of the mill 10 and as a consequence thereof, the details of the mill within the housing 11 has been shown in FIG. 1 in a fragmentary sectional view to illustrate the characteristics of the component making up the operative portions of the mill. These components include a material feed device 14 which is shown in silhouette and mounted on the casing 15 of the housing 11 adjacent the return inlet 13. Within the casing 15 there is an arrangement of a breaker plate 16 adjacent the feed device 14 and breaker plates 17 and 18 located beyond the return inlet 13 but still within the casing 15. The casing supports a drive shaft 19 which carries a plurality of hammer clusters 20 and 21 on an arrangement of hammer supporting discs 20A and 21A which are spaced in overlapping position along the axis of the shaft 19 between the end closures (not shown) for the casing 15. The hammer clusters 20 and 21, when the drive shaft 19 becomes operative, extend centrifugally outwardly so that the tips of the hammer clusters define a tip circle 22 that includes the tip. In the area of location of the feed device 14 there is shown the protruding tip 23 of the breaker bar 24 which has a width that extends along the axis of the rotor is close to the tip circle 22. The breaker bar 24 is spaced from a material guide plate 25 so that the feed of the material into the hammer clusters is confined across its width between the breaker bar 24 and the guide bar 25, while the tip 23 of the breaker plate 24 supports the material as close as possible to the tip circle 22 so that the material is effectively reduced to a fluff condition. The breaker bar 24 and its support plate 25 will have an effective width sufficient to support the sheet material M in the hammer tip circle.

A feature of the mill is that the breaker plate on the hammer advancing side of the breaker bar 24, and the breaker plates 17 and 18 on the trailing side of the breaker bar 24 furnish a roughened or a serrated surface which contributes to the creation of the fluff due to the velocity of the hammer clusters relative to the stationary plates. The breaker plate 16 follows very closely the tip circle 22, while the plates 17 and 18 beyond the breaker bar 24, define a clearance space relative to the tip circle 22 that decreases so the clearance has a wedge shape. In normal operation the tip speed of the hammer clusters is of the order of from about 16,000 to 22,000 feet per minute. Accordingly, there is created a tremendous turbulance within the mill casing 15 which is created by the velocity of the hammer clusters, and it is believed that the breaker plates 16, 17 and 18 combine with the speed of the hammer clusters to produce an exceedingly good fluff fiber.

The fluff produced by the mill 10 is developed from wood pulp material M, although other types of materials can be used to yield a fluff product, that has been converted into a matt that may be of the order of ¼" in thickness and with a width that will span the axial array of hammer clusters between the end plates of the casing 15. As the material M is fed through the feed device 14 it is caused to advance beyond the tip 23 of the breaker bar 24 where it is immediately impacted by the tips of the hammer clusters and fiberized in the manner above referred to.

Figure 2:
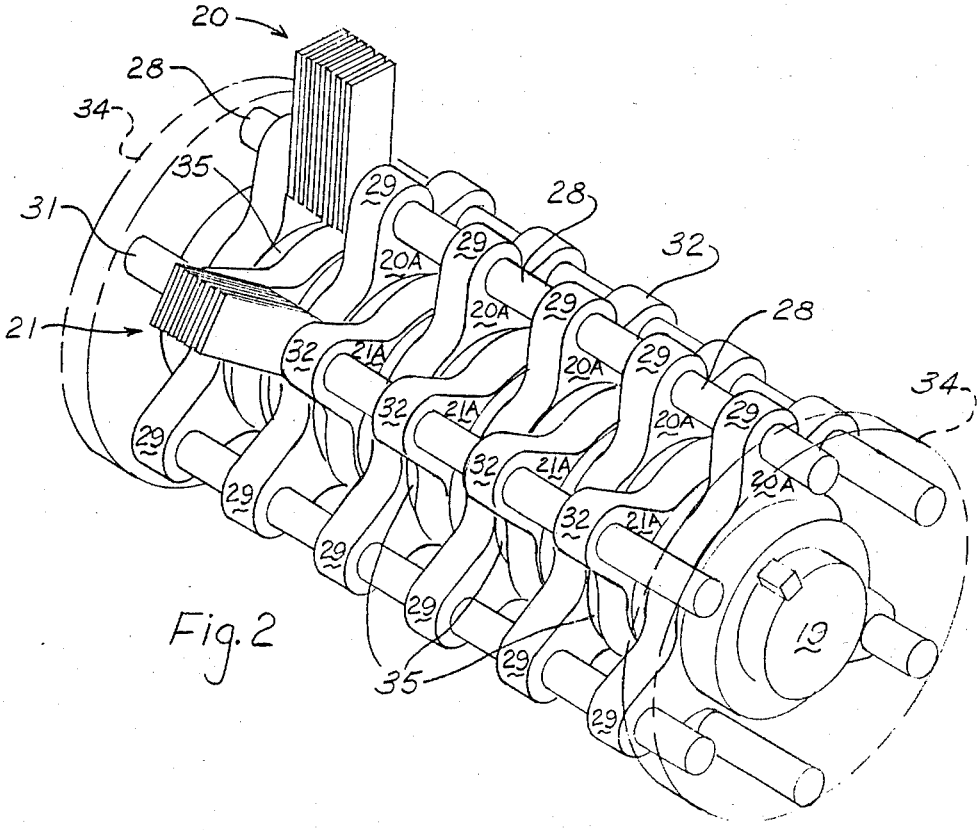
FIG. 2 is a perspective view of the hammer rotor which illustrates the full coverage of the hammers along the rotor axis of rotation so as to process roll or sheet material having a width commensurate with the span of the hammers along the axis of the rotor.

An important feature of the fluff mill 10 is shown in FIG. 2 where the hammer clusters 20 and 21 are seen to be mounted on separate supporting discs so that the clusters can be staggered in the axial direction of the drive shaft 19. The staggered arrangement provides a full coverage across the width of the breaker bar 24. Hammers heretofore employed which are aligned in the same circumferential path create dead spaces between hammers as the hammers follow each other past the breaker bar, such as breaker bar 24 seen in FIG. 1. With reference to FIG. 2 it is seen that the hammer cluster 20 is pivotally supported on a rod 28 which extends through suitable apertures in a pair of lobes 29 projecting from hammer supporting discs 20A. In the arrangement shown there are three lobes 29 on each disc 20A, and the lobes are circumferentially spaced at 120°. It is also seen that the second hammer cluster 21 is pivotally supported on a rod 31 which is suitably mounted in lobes 32 of hammer supporting discs 21A. Here again, the hammer cluster 21 is staggered or axially off set slightly from the hammer cluster 20 by reason of the supporting discs 21A being interleaved with the discs 20A whereby the lobes 29 and 32 are also interleaved. As pointed out before, the hammer supporting discs 21A are formed with three lobes 32 which are circumferentially spaced 120°. The complex structure for supporting the hammer clusters 20 and 21 makes it difficult to accurately show in a drawing. It is preferred to show in perspective the pivot rods 28 and 31 and the lobes 29 and 32 for the hammer clusters 20 and 21 and not to further complicate the drawing disclosure with other hammer clusters.

The drive shaft 19 extends between end plates 34, and there are spacer discs 35 spaced along the drive shaft 19 between the respective hammer supporting discs 20A and 21A. Thus the lobes 29 and 32 are maintained in proper interleaved alignment, and hammer clusters 21 overlap and follow hammer clusters 20. It is understood that around the complete circumference of the hammer assembly there are three hammer clusters 20 and also three hammer clusters 21. These hammer clusters are repeated axially along the length of the assembly.

The rotor assembly seen in FIG. 2 would have five hammer clusters 20 and 21 along its axis between the end plates 34, and there would be three sets of such clusters 20 and 21 around the axis of shaft 19. The number of hammer clusters circumferentially of the axis of rotation can change from three clusters to four, or even six or up to twelve clusters depending on the rotor hammer circle size and the number of lobes 29 and 32 formed on the respective discs 20A and 21A. While FIG. 2 illustrates a rotor assembly having an axial length sufficient to accommodate five hammer clusters, it is to be understood that the axial length may be varied for any particular mill. Since the axial length can be varied it follows that the breaker bar 24 will have a width to match the effective axial length of the rotor assembly as it presents the hammer clusters to the breaker bar with no gaps or dead spaces between the hammer clusters. For example, hammer cluster 21 follows cluster 20 and overlaps cluster 20, and so it is along the axis of the shaft 19.

Figure 3:
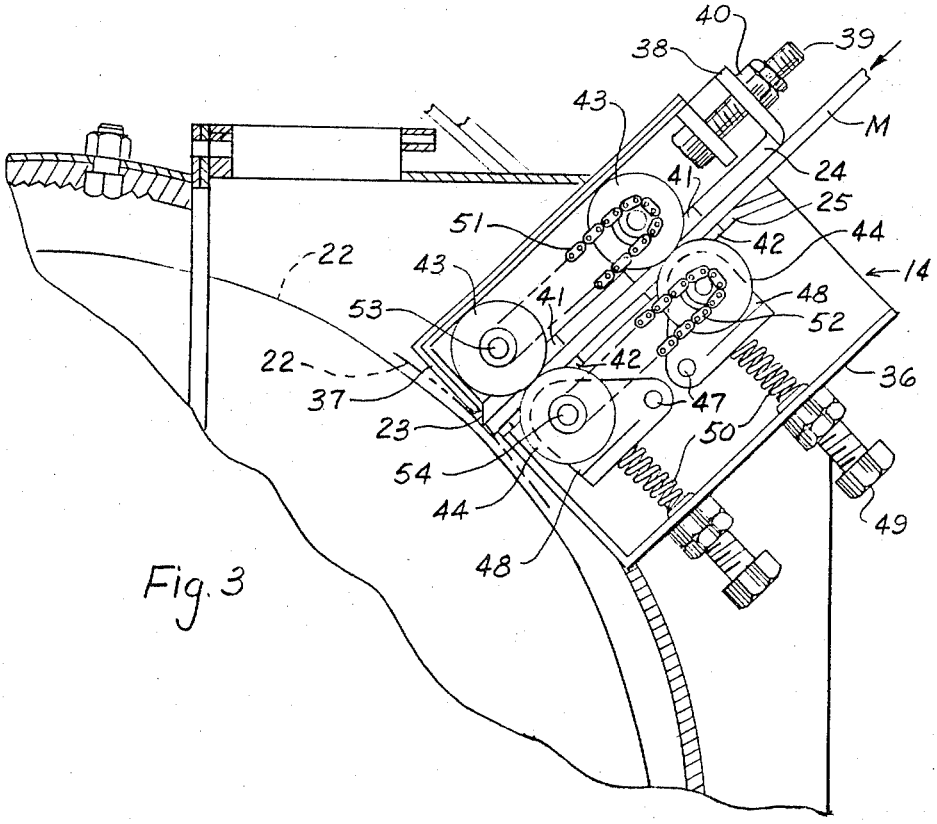
FIG. 3 is an enlarged fragmentary sectional view of the breaker bar adjustment provisions relative to the tip circle for the hammer clusters.

Turning now to FIG. 3, there is shown in fragmentary sectional disclosure the details of the feed device 14 first referred to in FIG. 1. The device has a suitable frame 36 which is supported in the housing 11 so that its inner end 37 closely approaches the hammer circle 22. The frame 36 is provided with an adjustable carrier 38 for the breaker bar 24 previously discussed. The tip portion 23 of the breaker bar is slightly beveled in order to present a sharp edge to the hammer circle 22, thereby assuring a clean break or impact as the hammers pass that tip 23. The breaker bar 24 may be moved in a direction along the diameter of the hammer circle by the adjustable carrier 38 which includes an adjusting screw 39 and a clamp nut 40 so that the bar 24 can be moved in or out to establish a desired clearance at the hammer circle 22, and as wear occurs it can be adjusted radially inwardly as desired. The material guide tip 23 bar is held in a relatively stationary position in the frame 36, and in spaced relationship to the plate 24 so as to provide a slot through which the matt of material M is caused to move into the hammers.

It is noted that the breaker bar 24 is provided with slots 41, and the guide plate 25 is also provided with slots 42 so as to permit the extension through these slots 41 and 42 of material feed rolls 43 on the adjustable breaker bar side and adjustable pinch rolls 44 operatively disposed on the guide plate side. It is to be noted that the adjustable breaker bar 24 has the slots 41 sized so as to permit adjusting movement of that bar 24 without interfering or engaging the rolls 43. On the other hand, the adjustable pinch rolls 44 are mounted by individual pivot pins 47 pivotally supporting frames 48 which are adapted to be positioned by adjusting screws 49 directly attached to each of the pivotal support frames 48, and resilient elements 50 are positioned between the fixed surface of the frame 36 and the pivot frames 48 so as to maintain the necessary load on the pinch rolls 44 operating through the slots 42 on the material to be fed into the mill hammers. The fixed position rolls 43 are interconnected by a suitable drive chain 51, and the pinch rolls 44 are interconnected by a second suitable drive chain 52 so that drive input to one shaft 53 of one of the rolls 43 and input to one of the shafts 54 of the pinch rolls 44 can be driven so that the surfaces of the respective rolls engage and force the matt of the material into the mill.

Figure 4:
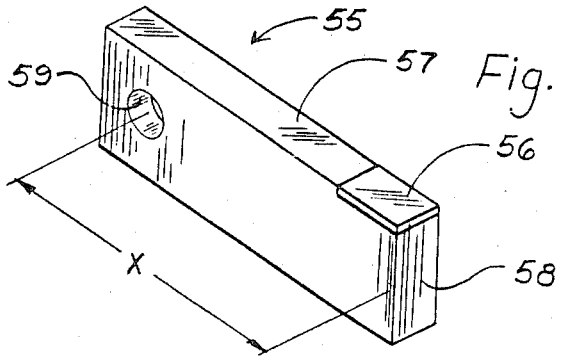
FIG. 4 is a perspective view of a preferred hammer.

FIG. 4 is a perspective view of a typical hammer 55 for each hammer cluster 20 and 21. The body of the hammer is formed from plate stock, but has a hardened cutter element 56 on the leading edge 57 at the tip 58. A mounting aperture 59 is located a predetermined distance X from the hammer tip 58, with a tolerance of plus or minus 0.005 inches. This dimension is imparted to each hammer so that all of the tip ends 57 of the hammer 54 will describe the same tip circle. If any elongation (stretch) occurs in time, the breaker bar 24 can be retracted to accommodate the hammer elements 55.

The foregoing disclosure includes an important improvement in the fluff mill art wherein the feeder device 14 is so constructed that while the rotor is operating, the tip 23 of the breaker bar 24 can be adjusted relative to the tip circle 22 to obtain the optimum impact effect of the hammers on the material to produce a most desirable fluff. One of the important improvements is related to the stretch effect experienced by the hammer clusters travelling at the velocities heretofore mentioned, making it necessary to adjust the breaker plate tip 23 so as to avoid impacting with the hammer, while not unduly increasing the clearance space. Over a period of use of the mill, adjustments can be made without shutting down the mill and that yields much improved adjustment which has not heretofore been possible.

There is an additions important feature present in the fluff mill and that is found in the construction of the frame 36 for the feed device 14 which allows locating a roller 43 and the cooperating pinch roller 44 extremely close to the tip circle 22. This feature permits the proper support and handling of the sheet pulp material with maximum production of fluff of a substantially uniform consistency. Although not believed necessary to show, the breaker bar 24 is formed with a plurality of slots 41 spaced across its width, and the shafts 53 carry rollers 43 that project through the slots 41. Similarly, the guide plate 25 is provided with a plurality of slots 42 spaced across its width to accommodate pinch rolls 44, and the pinch roll adjustment components 48 and 49 may be multiplied as needed to obtain substantially even or uniform pressure on the material M.

An additional feature of importance is the arrangement for mounting hammer clusters in overlapping relationship axially of the drive shaft 14 so as to avoid dead spaces between hammer rotors of the prior art which are located in the same plane of rotation rather than in overlapping planes of rotation which is obtained in the present embodiment.

What is claimed is:

1. A fluff mill for converting sheet material into a fluff product, said sheet material having a predetermined thickness and width, and said fluff mill comprising:

(a) a casing defining a chamber in which the fluff product is produced;

(b) sheet material feeding means connected to said casing, said feeding means having a breaker bar formed with slots and with a sheet material supporting end presented to the interior of said casing, said breaker bar supporting the sheet material across its predetermined width, said feeding means having a sheet material guide plate spaced from said breaker bar a distance to accommodate the thickness of the sheet material and formed with slots therein;

(c) sheet material feed rolls carried by said feeding means in position to project through said slots in said breaker bar and in said guide plate for engaging and feeding the sheet material;

(d) a rotor assembly operatively mounted in said casing, said rotor assembly having hammer elements mounted thereon such that they present outer tips which define a tip circle and said hammer elements having the outer tips arranged in overlapping positions to impact the sheet material across its entire predetermined width; and (e) breaker bar adjusting means carried by said sheet material feeding means in position to engage and adjust the position of said breaker bar end selectively relative to said hammer tip circle to obtain an operating gap spacing between the hammer tip circle and said breaker bar end to control the reduction of the sheet material into the fluff product, said breaker bar adjustment being effective by said slots therein accommodating said feed rolls.

2. The fluff mill set forth in claim 1 wherein a plurality of breaker plates are mounted within said casing in positions embracing said rotor assembly outside said hammer tip circle, a first one of said breaker plates is positioned with and end portion adjacent said breaker bar, and other of said breaker plates are positioned beyond said breaker bar in relation to the direction of rotation of said rotor assembly, said others of said breaker plates defining surfaces that form with said tip circle an elongated V-shaped region widest adjacent said breaker bar and progressively narrowing on approaching the hammer tip circle spaced from said breaker bar in the direction of rotation of said rotor assembly.

3. In a fluff mill having a casing and a rotor assembly operatively mounted in said casing with material impact hammers operably mounted on said rotor assembly, the hammer tips traversing a hammer circle of a predetermined diameter, the improvement comprising:

(a) sheet material feeder device mounted on said casing and including:

(1) a breaker bar having a leading edge extending into the interior of said casing and presented toward said hammer circle, and a guide plate spaced from said breaker bar to provide a space opening into said casing close to said hammer circle and between said breaker bar and said guide plate for reception of material to be impacted by said rotor hammers, (2) roller means in said feeder device projecting through said breaker bar and into said material reception space, (3) material pinch rolls projecting through said guide plate and into said material reception space and positioned to cooperate with said roller means such that the material is engaged by and between said roller means and pinch rolls; and (b) drive input means operatively engaged with said roller means and with said pinch rolls for advancing material engaged therebetween into the hammer circle in said casing beyond said breaker bar to be impacted by the impact hammers.

4. In a fluff mill having a casing in which sheet material is converted into a fluff product, the improvement in the mill comprising:

(a) a rotor assembly including;

(1) an axially elongated drive shaft operable in the casing, (2) a first group of discs on said shaft formed with radially projecting lobes positioned in circumferentially spaced relation around the drive shaft, (3) a second group of discs on said shaft formed with radially projecting lobes positioned in circumferentially spaced relation around the drive shaft, (4) spacer means on said drive shaft disposed between said first and second groups of discs and said groups of discs have the respective lobes arranged in axially interleaved relation along the axis of said drive shaft, (5) pivot rods carried by the respective lobes on said first and second groups of discs; and (b) multiple hammer clusters mounted on each of said pivot rods, with the hammer clusters carried between said first group of discs being axially offset and in overlapping relation to the hammer clusters carried between said second group of discs such that said hammer clusters present in ninety degrees of rotation of said drive shaft a continuous and uninterrupted array of hammers along the drive shaft axis with no gaps between the hammer clusters during the rotation thereof.

5. In a fluff producing hammer mill fed with material to be processed into a fluff product, the combination comprising:

(a) a casing defining a chamber in which the material is transformed into a fluff product;

(b) an axially elongated rotor assembly operably mounted in said casing chamber and including hammer means arranged along the axis of said rotor assembly to present a continuous and unbroken array of tip portions of said hammer means moving in a predetermined tip circle, said unbroken array of tip portions being formed in axially overlapping positions along said axial length of said rotor assembly;

(c) material feed means connected to said casing in position to direct material into said casing chamber within reach of said hammer tips moving in said predetermined tip circle, said feed means having a slotted breaker bar and an adjacent slotted material guide plate forming a space therebetween for directing the material into said hammer predetermined tip circle, and said breaker bar having a tip end projecting into said casing for supporting the material adjacent said predetermined tip circle; and (d) operable means in said material feed means for effecting adjustment of the position of said breaker bar to locate said breaker bar tip end in said casing relative to said predetermined tip circle for supporting the material as it is fed into the path of said predetermined tip circle for impact by said hammer tips, said operable means including material engaging feed rolls extending through said slotted breaker bar to accommodate adjustment of said breaker bar.

6. In a fluff producing hammer mill as set forth in the combination of claim 5 wherein said breaker bar adjustment means is operable for permitting breaker bar adjustments concurrently with operation of said rotor assembly to obtain a predetermined operating relationship between said breaker bar tip end and said predetermined tip circle.

7. In a fluff mill having a casing in which material is converted into a fluff product, the improvement comprising:

(a) a rotor assembly including;

(1) a drive shaft rotationally operable in the casing, (2) a plurality of discs carried by said drive shaft, each of said discs being formed with circumferentially spaced lobes projecting radially outwardly and provided with apertures, (3) spacer means on said drive shaft separating said plurality of discs axially along said drive shaft, and said discs being rotationally oriented on said drive shaft whereby alternate discs are rotated so said lobes thereon align in groups and have the apertures therein in axial alignment, and (4) rod elements mounted through said axially aligned apertures of said alternate disc groups, said rod elements between lobes being in circumferential alignment with alternate ones of said disc lobes; and (b) hammer elements mounted on said rod elements extending between aligned lobe apertures for pivotal swinging movement such that said hammer elements are axially staggered to provide a continuous and uninterrupted presence of hammers along the axis of the drive shaft upon rotation of said drive shaft.

* * * * *